US010227701B2

(12) United States Patent
Hoormann et al.

(10) Patent No.: US 10,227,701 B2
(45) Date of Patent: Mar. 12, 2019

(54) INSULATING FRAME WITH CORNER EXPANSION JOINTS FOR ELECTROLYSIS CELLS

(71) Applicant: UHDENORA, S.P.A., Milan (IT)

(72) Inventors: Dirk Hoormann, Werne a.d. Lippe (DE); Dmitri Donst, Köln (DE); Frank Funck, Bottrop (DE); Philipp Hofmann, Dortmund (DE); Gregor Polcyn, Dortmund (DE); Peter Toros, Essen (DE); Peter Woltering, Neuenkirchen (DE)

(73) Assignee: UHDENORA S.P.A., Milan (IT)

( * ) Notice: Subject to any disclaimer, the term of this patent is extended or adjusted under 35 U.S.C. 154(b) by 105 days.

(21) Appl. No.: 14/414,490

(22) PCT Filed: Jul. 12, 2013

(86) PCT No.: PCT/EP2013/064830
§ 371 (c)(1),
(2) Date: Jan. 13, 2015

(87) PCT Pub. No.: WO2014/009549
PCT Pub. Date: Jan. 16, 2014

(65) Prior Publication Data

US 2015/0167188 A1 Jun. 18, 2015

(30) Foreign Application Priority Data

Jul. 13, 2012 (DE) ..... 10 2012 013 832

(51) Int. Cl.
*C25B 13/02* (2006.01)
*C25B 9/08* (2006.01)
*C25B 9/10* (2006.01)

(52) U.S. Cl.
CPC ..... *C25B 13/02* (2013.01); *C25B 9/08* (2013.01); *C25B 9/10* (2013.01)

(58) Field of Classification Search
CPC ..... C25B 13/02; C25B 9/08; C25B 9/10
See application file for complete search history.

(56) References Cited

U.S. PATENT DOCUMENTS

| | | | |
|---|---|---|---|
| 3,855,104 | A | 12/1974 | Messner |
| 3,864,236 | A | 2/1975 | Lindstrom |
| 4,176,018 | A | 11/1979 | Cathala et al. |

(Continued)

FOREIGN PATENT DOCUMENTS

| | | |
|---|---|---|
| DE | 10249508 | 5/2004 |
| DE | 102004028761 | 1/2006 |
| DE | 102006020374 | 10/2007 |

OTHER PUBLICATIONS

International Search Report issued in PCT Application No. PCT/EP2013/064830.

*Primary Examiner* — Ciel P Thomas
(74) *Attorney, Agent, or Firm* — Lucas & Mercanti, LLP

(57) ABSTRACT

An insulating frame for electrolysis cells is proposed, which has a geometric form with corners, said insulating frame being of a flat design and having an anode and a cathode side as well as an outer and inner end face, the insulating frame being characterized in that it is has an edge area directly adjoining the inner end face, characterized in that in the area of the corners the edge area has corner expansion joints in the form of cut-outs.

9 Claims, 2 Drawing Sheets

(56) References Cited

U.S. PATENT DOCUMENTS

Figure 1:
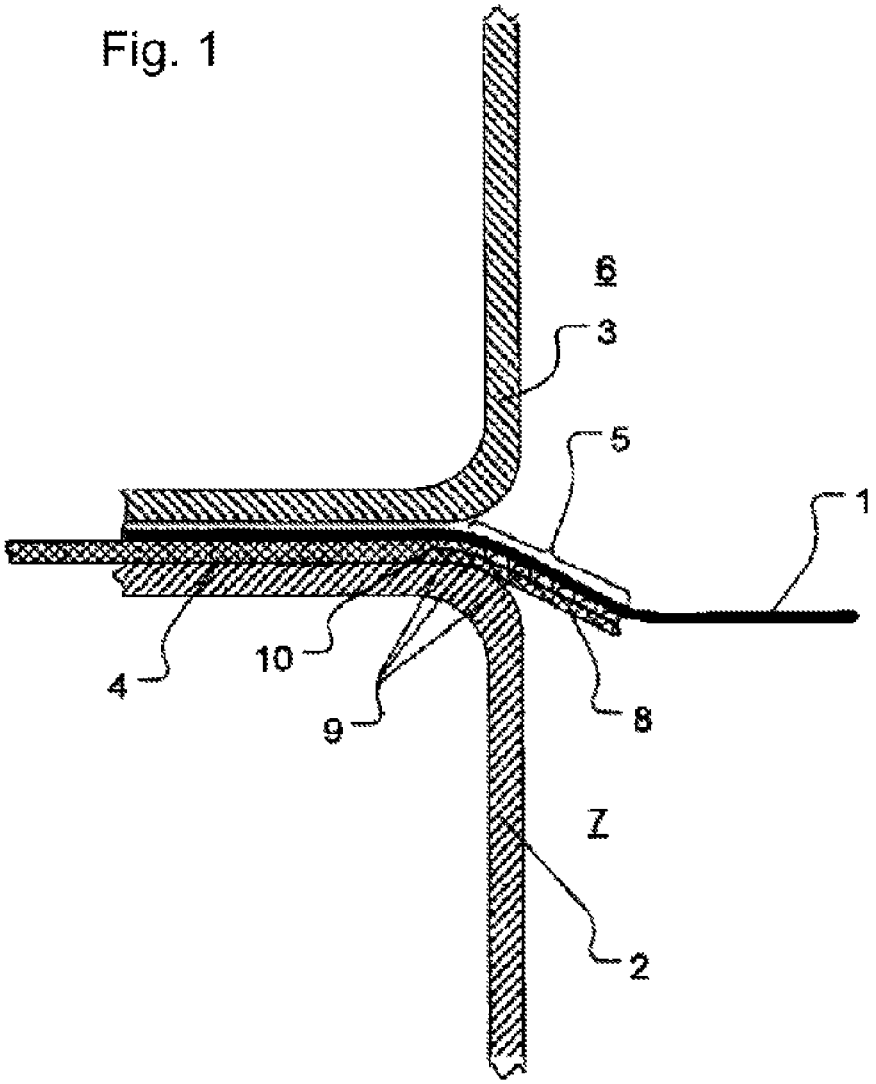

| | | | | |
|---|---|---|---|---|
| 2002/0110719 | A1 | 8/2002 | Pien | |
| 2009/0159435 | A1* | 6/2009 | Baumer | C25B 9/08 204/252 |
| 2012/0118729 | A1* | 5/2012 | Liang | B01D 61/48 204/267 |

* cited by examiner

INSULATING FRAME WITH CORNER EXPANSION JOINTS FOR ELECTROLYSIS CELLS

This application is a U.S. national stage of PCT/EP2013/064830 filed on Jul. 12, 2013 which claims the benefit of priority from German Patent Application No. 102012013832.6 filed Jul. 13, 2012, the contents of each of which are incorporated herein by reference.

FIELD OF THE INVENTION

The invention relates to an insulating frame for electrolysis cells, which is characterised in that it has an internal edge area having corner expansion joints in its corners. The design of the corner expansion joints is such that they can compensate linear expansion of the insulating frame. Also the invention comprises an electrolysis cell provided with said insulating frame.

PRIOR ART

Electrolysis cells for the production of elemental chlorine, hydrogen and/or caustic soda are known and described extensively in prior art. In conventional prior art two design types are predominantly described which are widely used in the industry. One of the two types is the filter press type and the other type is the so-called "single cell elements" type, which consists in single cells electrically connected in series.

These electrolysis cells of the single cell elements type, which are for instance described in DE 10249508 A1 (Uhde) or DE 102004028761 A1 (Uhdenora), consist, inter alia, of a cathodic and an anodic compartment shell, which contains the cathode or the anode, respectively. An ion exchange membrane, held between flanges, is located between the electrodes. As described in the above prior art, an insulating frame is arranged between the flange of the anode compartment shell and the membrane, so that in installed condition the membrane is clamped between the surface of the flange of the cathode compartment shell and the surface of the insulating frame and thus held in place.

Also from DE 102006020374 A1 (Uhdenora) insulating frames for electrolysis cells are known. These are characterised in that the edge area has a microstructure, e. g. in the form of fine knobs. This ensures the presence of a liquid film which protects the membrane against dehydration.

The insulating frame also serves for keeping the membrane, which is used during operation of the electrolysis cell, away from the metal surfaces of the anode compartment shell. Here the transitional area from the anode compartment shell to the flange is of special importance as the flange must be prevented from contact to the membrane which would cause short circuit currents or membrane damage. To preclude this, the insulating frame is slightly oversized and equipped with an edge area which protrudes a few millimeters into the interior of the electrolysis cell and keeps the membrane away from the adjacent metal surfaces of the compartment shell.

However, it is disadvantageous that during operation of the electrolysis cell a temperature-induced elongation of the metallic material may occur. In case of distortion of the insulating frame there is the risk of membrane damage. This in turn may require shut-down of the electrolysis cell and replacement of the membrane. However, a long membrane service life is directly linked to the cost-effectiveness of the electrolysis process.

Thus the objective of the present invention consisted in providing an insulating frame for electrolysis cells which reliably avoids the disadvantages of prior art described above and which is in particular designed so as to compensate and/or deflect the deformation forces occurring during operation of the electrolysis cell in such a manner as to avoid damage of the membrane, especially in the corners of the frame edge, and so that possible deformations occur preferably in the edge area facing away from the membrane.

DESCRIPTION OF THE INVENTION

A first subject of the invention relates to an insulating frame for electrolysis cells, which has a geometric form with corners, said insulating frame being of a flat design and having an anode and a cathode side as well as an outer and inner end face, the insulating frame being characterised in that the is has an edge area directly adjoining the inner end face, characterised in that the edge area has corner expansion joints in the form of cut-outs, the cut-outs being designed so as to compensate linear expansion of the insulating frame.

Surprisingly, it was found that the arrangement according to the invention completely meets the objective described above. The corner expansion joints consist in material cut-outs which in case of mechanical pressure exerted on the membrane absorb and deflect these forces. Preferably the expansion joints in the insulating frame are arranged so as to face away from the membrane. This also ensures that frame deformations always occur away from the membrane providing additional protection. The insulating frame according to the invention thus reduces problems related to buckling and deformations occurring during operation of the electrolysis plant, reduces the risk of membrane damage and thus significantly extends the service life of the membranes.

In a first preferred embodiment the edge area is arranged continuously and without gaps along the circumference of the inner end face.

In a further advantageous embodiment of the insulating frame according to the invention, the edge area is of such a structure that it can be flown through by an electrolyte if completely or partly covered, the said edge area ideally having a microstructured surface.

This embodiment of the frame area of the insulating frame is advantageous, as described in DE 102006020374A1, in order to protect the membrane against further damage, such as fissures. If the frame area is not provided with a microstructure, this results in the following scenario: As the pressure in the cathode compartment is higher than the pressure in the anode compartment, the membrane is bent towards the anode compartment and/or pressed onto the unsupported portion of the frame and only wetted from one side in this area of contact. Because of the cover on the anode side, the hygroscopic lye dehydrates the membrane in this area, this dehydration being accompanied by proportionate precipitation of salts in the carboxylic layer which subsequently leads to bubble formation, delamination of both membrane layers and/or fissures. Such damage can be partly seen with the naked eye or established because of an increased $Cl^-$ concentration in the lye, as chloride ions can diffusively enter the cathode compartment along the damaged edge area.

For this purpose the edge area on the cathode side advantageously has the form of a flatter step on which a multitude of elevations are arranged. These elevations can have any form, however, preferably, they have the form of cylindrical or half-spherical elevations in the material. In addition, the edge area can have the form of a sequence of wave or tooth type elevations and indentations. The structure is so that the waves or teeth are open towards the centre of the frame, so that the anolyte can flow in or diffusively enter from the anode compartment and/or flow out of this area afterwards. In an improved embodiment, the waves or teeth have a multitude of small openings which improves the inflow and outflow of the anolyte. These openings can have the form of holes, channel type cut-outs or other geometric forms.

The microstructured surface thus serves to protect the membrane against dehydration, i.e. against chemical damage. However, it has no function with regard to deflecting deformation forces as the microstructure is too rigid for this purpose.

A further improvement of the structured edge area of the insulating frame according to the invention, consists in the edge area having a multitude of small openings, bores or holes, which completely penetrate the insulating frame. These openings are interconnected via channels, inserted into the surface of the insulating frame. Preferably these channels are located on the far side of the membrane, i.e. on the anode side. This embodiment can be improved in that the channels, which interconnect the openings and/or are directed towards or away from the internal end face, are inserted in both surfaces of the insulating frame. The bilateral channel structure enhances inflow and outflow of the anolyte.

In an advantageous embodiment of the invention, the edge area in the area of the corners is unstructured. Preferably the edge area features 1 to 10 corner expansion joints in each corner, preferably 3 to 5 corner expansion joints each and most preferably 3 corner expansion joints each. In a further preferred embodiment, one of the corner expansion joints each is directly located in the corner of the edge area and at a pointed angle to the outer end face of the insulating frame As an alternative, the invention provides for corner expansion joints arranged at a right angle to the outer end face of the insulating frame.

According to the invention, the dimensions of the corner areas, where the corner expansion joints are located, are 1.5 to 10 cm and preferably 3 to 6 cm.

Preferably the corner expansion joints are shaped as semi-spherical or semi-cylindrical cut-outs.

The invention also comprises an electrolysis cell with an anode compartment shell and a cathode compartment shell physically separated by a membrane and provided with the insulating frame according to the invention in one of the described embodiments for sealing both cell compartment shells and/or fastening the membrane.

EXAMPLES

The present invention is explained in more detail below using several figures.

FIG. 1: Flange area of an electrolysis cell in a sectional view according to prior art.

Figure 2:
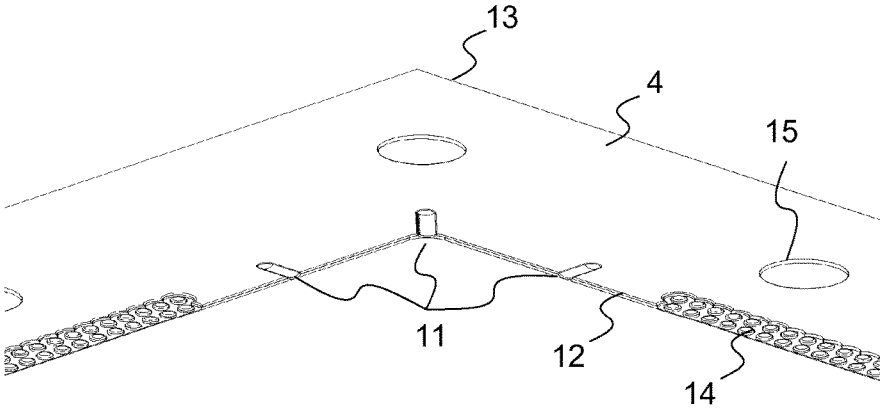

FIG. 2: Top view of a section of a corner of the insulating frame according to the invention.

In FIG. 1 below the flange area of an electrolysis cell is shown in a sectional view. Membrane 1 is clamped between both halves of the flange of anode compartment shell 2 and cathode compartment shell 3, insulating frame 4 being arranged between 20 anode compartment shell 2 and membrane 1. When normally installed, an unsupported portion 5 of insulating frame 4 protrudes into the interior of the electrolysis cell. As the pressure in cathode compartment 6 exceeds the pressure in anode compartment 7 by approximately 20-40 mbar, membrane 1 is pressed onto the unsupported portion of frame 4.

In an exemplary manner with view to preventing possible membrane damage resulting from this pressing, edge area 8 is equipped with a multitude of knobs 9 in the form of semi-spheres which support membrane 1 without completely covering the membrane side facing anode compartment 7. The present objective of the invention, however, is also attained if the edge area 8 does not have a microstructured surface. In the present exemplary embodiment, insulating frame 4 and stepped edge 10 are positioned so that stepped edge 10 lies in the flange area of both compartment shells. In installed position, membrane 1 is thus squeezed off in a defined manner at stepped edge 10 and deactivated on both sides. During operation, linear expansion of the insulating frame occurs in the area of the corners of electrolysis cells which causes membrane damage. The present invention strives to solve this problem by providing the insulating frame according to the invention.

FIG. 2 shows a top view of a section of a corner of insulating frame 4 according to the invention in an embodiment with three corner expansion joints 11, which, in this example, have semi-cylindrical form. The central of the three corner expansion joints is positioned directly in the corner of the edge area at a pointed angle to the outer end face of the insulating frame. In the figure, edge area 8 with a multitude of openings 14 is shown between outer end face 13 and inner end face 12. Outside of edge area 8, larger openings 15 are shown which serve as a passage for tightening bolts not shown in the drawing used for closing the flange also not shown in the drawing. Because of the arrangement of corner expansion joints 11 shown in this figure, the membrane cannot be damaged any more by insulating frame 4 when it expands during operation of the electrolysis cell. Linear expansion of insulating frame 4 is compensated by the corner expansion joints so that the frame does not buckle any more and thus not damage the membrane any more.

The invention claimed is:

1. An insulating frame for membrane electrolysis cells, which has a geometric form with corners, said insulating frame being of a flat design and having an anode side and a cathode side as well as an outer end face and an inner end face, between the outer end face and the inner end face of the insulating frame an edge area is directly adjoining the inner end face, wherein the edge area of the insulating frame comprises a multitude of openings along the edge area and the multitude of openings are arranged on the anode side facing away from a membrane of the membrane electrolysis cell, when the insulating frame is installed therein, to compensate linear expansion, wherein areas abutting the corners of the insulating frame comprises corner expansion joints in the form of material cut-outs, wherein the edge area features 3 to 5 of the corner expansion joints in each corner, wherein one of the corner expansion joints each is located directly in the corner of the edge area and at a pointed angle to the outer end face of the insulating frame.

2. The insulating frame according to claim 1, wherein the edge area is of such a structure that it can be flown through by an electrolyte if completely or partly covered.

3. The insulating frame according to claim 1, wherein the edge area has a microstructured surface.

4. The insulating frame according to claim 1, wherein the edge area has the form of a sequence of wave or tooth type elevations and indentations.

5. The insulating frame according to claim 1, wherein at least one of the corner expansion joints are arranged at a right angle to the outer end face of the insulating frame.

6. The insulating frame according to claim 1, wherein the dimensions of the corner areas, where the corner expansion joints are located, are 1.5 to 10 cm.

7. The insulating frame according to claim 6 wherein the dimensions of the corner areas, where the corner expansion joints are located, are 3 to 6 cm.

8. The insulating frame according to claim 1, wherein the corner expansion joints have the form of semi-spherical or semi-cylindrical cutouts.

9. An electrolysis cell, comprising an anode compartment shell and a cathode compartment shell, which are physically separated by a membrane and equipped with an insulating frame according to claim 1.

* * * * *